United States Patent [19]

Grunert et al.

[11] Patent Number: 4,554,421

[45] Date of Patent: Nov. 19, 1985

[54] MOLDED CASE CIRCUIT BREAKER WITH HANDLE LOCK

[75] Inventors: Kurt A. Grunert, Beaver; Joseph F. Changle, Scott, both of Pa.

[73] Assignee: Westinghouse Electric Corp., Pittsburgh, Pa.

[21] Appl. No.: 719,036

[22] Filed: Apr. 3, 1985

Related U.S. Application Data

[63] Continuation of Ser. No. 569,056, Jan. 9, 1984, abandoned.

[51] Int. Cl.[4] ..... H01H 9/28

[52] U.S. Cl. ..... 200/43.15

[58] Field of Search ..... 200/42 R, 42 T, 44, 200/321, 325, 330

[56] References Cited

U.S. PATENT DOCUMENTS

| | | | |
|---|---|---|---|
| 3,171,908 | 3/1965 | Malota | 200/330 |
| 3,260,808 | 7/1966 | Dimond et al. | 200/42 T |
| 3,816,686 | 6/1974 | Budd et al. | 200/330 |
| 3,833,784 | 9/1974 | Bobel et al. | 200/330 |
| 4,271,342 | 6/1981 | Sistare | 200/321 |

FOREIGN PATENT DOCUMENTS

| | | | |
|---|---|---|---|
| 2390569 | 1/1979 | France | 200/42 T |
| 282423 | 4/1928 | United Kingdom | 200/44 |

*Primary Examiner*—John W. Shepperd

*Attorney, Agent, or Firm*—M. S. Yatsko

[57] ABSTRACT

A molded case circuit breaker includes a handle lock or locking mechanism for preventing unauthorized use of the circuit breaker. The locking mechanism includes a lock cover disposed over a manually engagable handle of the circuit breaker and a spring biased locking cylinder and spindle assembly disposed normally above the lock cover and movable along an elongated slot formed through the lock cover. The cylinder and spindle assembly is mechanically connected to the handle for movement in unison therewith. The elongated slot includes an enlarged locking portion that is located along the lock cover in a position corresponding to the OFF position of the handle and the OPEN position of the separable electrical contacts of the circuit breaker. An elongated cylinder of the cylinder and spindle assembly is receivable through the locking portion of the elongated slot and when retained therein prevents substantial movement of the handle from its OFF position.

14 Claims, 6 Drawing Figures

MOLDED CASE CIRCUIT BREAKER WITH HANDLE LOCK

This application is a continuation of application Ser. No. 569,056, filed Jan. 9, 1984, now abandoned.

CROSS REFERENCE TO RELATED APPLICATIONS

The invention disclosed herein relates to molded case circuit breakers. The inventions disclosed in the following four commonly assigned U.S. patent applications also relate to molded case circuit breakers: U.S. patent applications Ser. Nos. 440,680; 440,681; 440,682; and 440,683, all of which were filed on Nov. 10, 1982. In addition, commonly assigned U.S. patent application Ser. No. 450,857 filed on Dec. 17, 1982 also relates to molded case circuit breakers.

The following six commonly assigned U.S. patent applications were all filed in the U.S. Patent and Trademark Office on Dec. 19, 1983, and relate to molded case circuit breakers: Ser. No. 562,647 filed by Alfred E. Maier and entitled Molded Case Circuit Breaker With An Apertured Molded Cross Bar For Supporting A Movable Electrical Contract Arm; Ser. No. 562,648, filed by Robert H. Flick and Walter K. Huffman and entitled Molded Case Circuit Breaker With Movable Upper Electrical Contact Positioned By Tension Springs Ser. No. 562,643, filed by Robert H. Flick and Walter K. Huffman and entitled Molded Case Circuit Breaker With Improved Operating Mechanism; Ser. No. 562,644, filed by Alfred A. Maier and entitled Molded Case Circuit Breaker With Adjustable Stationary Lower Electrical Contact, Ser. No. 562,602, filed by Robert H. Flick and Walter K. Huffmann and entitled Molded Case Circuit Breaker With Movable Lower Electrical Contact; and Ser. No. 562,603, filed by Robert H. Flick and Walter K. Huffman and entitled Molded Case Circuit Breaker With Movable Upper Electrical Contact Positioned By Torsion Springs.

Finally, the following five commonly assigned U.S. patent applications were filed in the U.S. Patent and Trademark Office on Jan. 9, 1984, and relate to molded case circuit breakers: Ser. No. 569,059, filed by Alfred E. Maier and entitled Molded Case Circuit Breaker With Cross Bar Stop Molded In Base Of; Ser. No. 569,058, filed by Dante Bagalini and entitled Molded Case Circuit Breaker With Resettable Combined Undervoltage And Manual Trip Mechanism; Ser. No. 569,057, filed by Robert H. Flick and Lawrence D. Dennis and entitled Molded Case Circuit Breaker With Adjacent Pole Mechanism Spaced Closer Than Adjacent Terminals; Ser. No. 569,055, filed by Joseph J. Matsko, Kurt A. Grunert and Bruce R. Terhorst, and entitled Solenoid Operator Circuit For Molded Case Circuit Breaker and Ser. No. 569,054, filed by Kurt A. Grunert and Walter K. Huffman and entitled Molded Case Circuit Breaker With Single Solenoid Operator For Rectilinear Handle Movement.

BACKGROUND OF THE INVENTION

A. Field of the Invention

The device of the present invention generally relates to molded case circuit breakers and, more particularly, to mechanisms for locking the handles of circuit breakers to prevent unauthorized operation thereof.

B. Description of the Prior Art

Circuit breakers and, more particularly molded case circuit breakers are old and well known in the prior art. Examples of such devices are disclosed in U.S. Pat. Nos. 2,186,251; 2,492,009; 3,239,638; 3,525,959; 3,590,325; 3,614,685; 3,775,713; 3,783,423; 3,805,199; 3,815,059; 3,863,042; 3,959,695; 4,077,025; 4,166,205; 4,258,403; and 4,295,025. In general, prior art molded case circuit breakers have been provided with movable contact arrangements and operating mechanisms designed to provide protection for an electrical circuit or system against electrical faults, specifically, electrical overload conditions, low level short circuit or fault current conditions, and, in some cases, high level short circuit or fault current conditions. Prior art devices have utilized an operating mechanism having a trip mechanism for controlling the movement of an over-center toggle mechanism to separate a pair of electrical contacts upon an overload condition or upon a short circuit or fault current condition. Such trip mechanisms have included a bimetal movable in response to an overload condition to rotate a trip bar, resulting in the movement of the over-center toggle mechanism to open a pair of electrical circuit breaker contacts. Such prior art devices have also utilized an armature movable in response to the flow of short circuit or fault current to similarly rotate the trip bar to cause the pair of contacts to separate. At least some prior art devices use blow-apart contacts to rapidly interrupt the flow of high level short circuit or fault currents. Typical prior art circuit breakers utilize manually engagable handles for moving separable electrical contacts into engagement and out of engagement and for resetting the contacts subsequently to a trip operation. Often, such manually engagable handles are operated from a remote location by means of an electrical operator. It is often desirable to lock the manually engageable handle or the electrical operator for the handle when the separable electrical contacts are out of engagement or in their OPEN position in order to prevent unauthorized or accidental use of the circuit breaker.

While many prior art devices have provided adequate protection against fault conditions in an electrical circuit, a need exists for dimensionally small molded case circuit breakers capable of fast, effective and reliable operation and, more specifically, for effective, inexpensive and reliable lock mechanisms to prevent the unauthorized use of electrical circuit breakers.

SUMMARY OF THE INVENTION

An object of the present invention is to provide a new and improved circuit breaker.

Another object of the present invention is to provide a new and improved molded case circuit breaker having a handle lock for preventing the unauthorized use of the circuit breaker.

Briefly, the present invention relates to a molded case circuit breaker having a locking mechanism engagable with a manually engagable handle for preventing the unauthorized use of the circuit breaker. The locking mechanism includes a lock cover with an elongated keyhole shaped slot formed therethrough that cooperates with a spring biased locking cylinder and spindle assembly to lock the handle in its OFF or OPEN position and, alternately, to enable authorized operation of the handle for resetting the operating mechanism of the circuit breaker or for closing the separable electrical contacts of the circuit breaker. A spring biased locking cylinder may be depressed into an enlarged locking portion of the slot, thereby exposing an aperture formed through an upper portion of an elongated spindle to receive a lock hasp and to lock the handle in its OFF position.

BRIEF DESCRIPTION OF THE DRAWING

The above and other objects and advantages and novel features of the present invention will become apparent from the following detailed description of the preferred and alternative embodiments of a molded case circuit breaker illustrated in the accompanying drawing wherein.

DESCRIPTION OF THE PREFERRED EMBODIMENT

Figure 1:
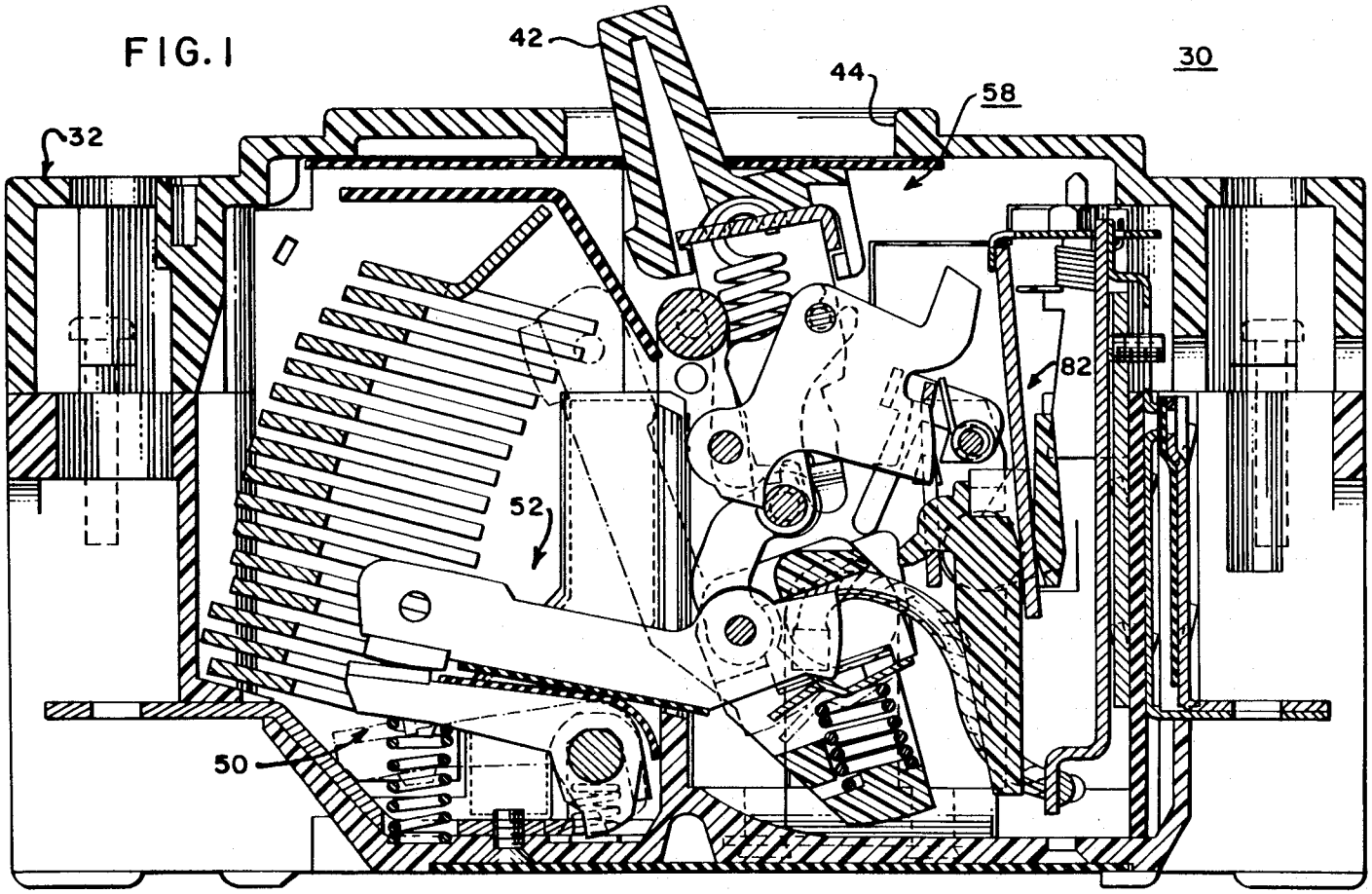
FIG. 1 is an enlarged, cross sectional view of a molded case circuit breaker, depicting the device in its CLOSED and BLOWN-OPEN positions.

The present invention relates to mechanisms for locking the handles 42 of circuit breakers 30 of the type where an operating mechanism 58 operates either in response to movement of the handle 42 or in response to a trip unit 82 to move a movable contact 52 into and out of CLOSED and OPEN positions with respect to a lower contact 50. A detailed description of such a molded case circuit breaker 30 which can preferably be utilized with the handle locking mechanism 410 of the present application can be found from page 7, line 30 to page 27, line 26 of U.S. application Ser. No. 562,643, filed Dec. 19, 1983, which material is incorporated hereinto by reference.

Figures 2, 3, 4, 5, 6:
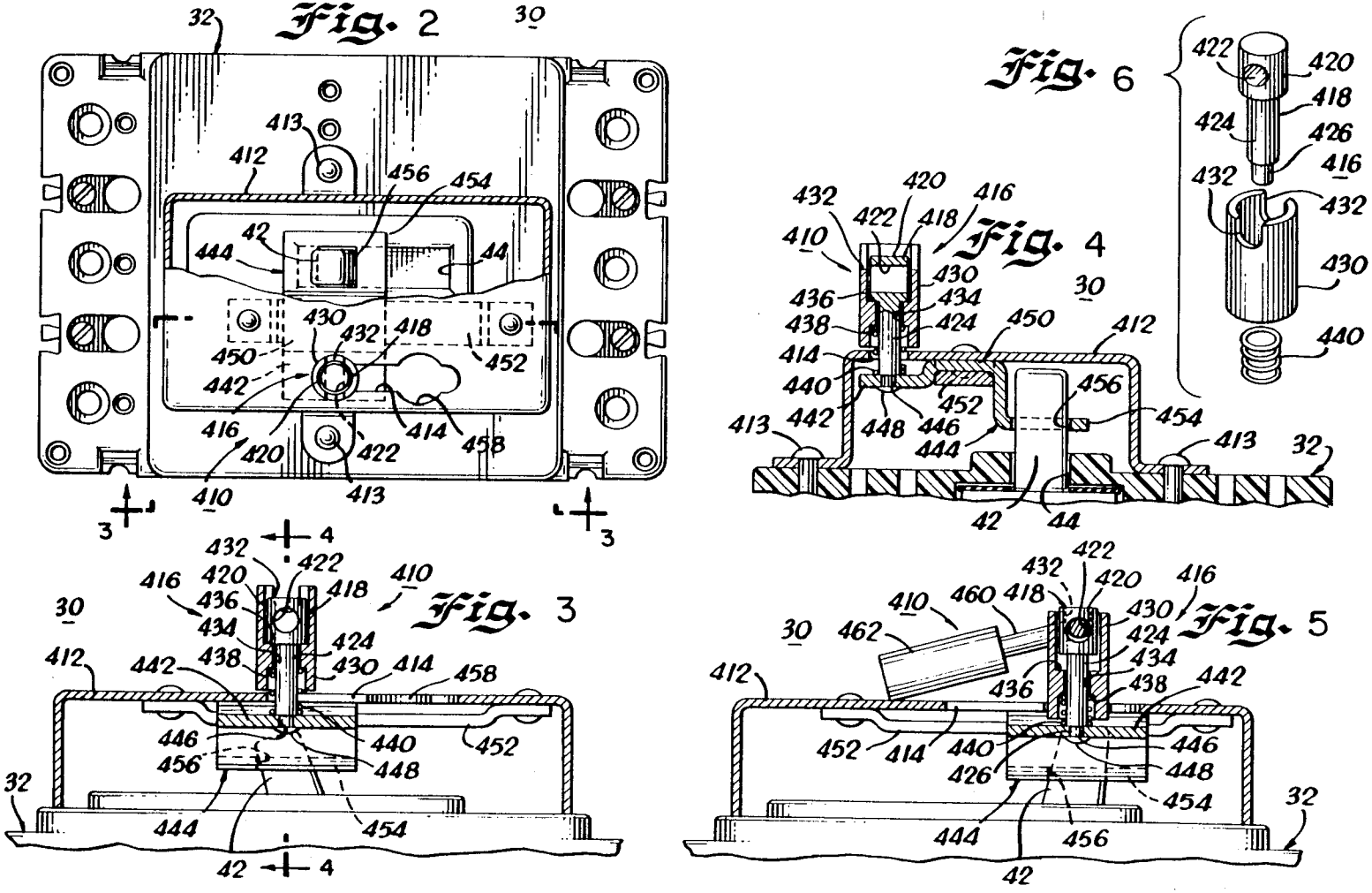
FIG. 2 is a top elevational view of the device of FIG. 1, depicting a handle lock or locking mechanism.
FIG. 3 is an enlarged, cross sectional view of the handle lock of FIG. 2 taken along line 3—3 of FIG. 2, depicting the handle in its ON position.
FIG. 4 is an enlarged, cross sectional view of the handle lock of FIG. 2 taken along lines 4—4 of FIG. 3.
FIG. 5 is a view similar to FIG. 3 depicting the handle locked in its OFF position.
FIG. 6 is an enlarged, exploded perspective view a portion of the handle lock of FIG. 2.

In accordance with the present invention (FIGS. 1–6), a handle lock or locking mechanism 410 is provided for enabling only authorized use of the circuit breaker 30. The locking mechanism 410 includes a rigid, tamper resistant lock cover 412 having an elongated keyhole shaped slot 414 formed therethrough and secured by any suitable tamper resistance means, for example, a plurality of rivets 413, to the top cover 32. The slot 414 cooperates with a spring biased locking barrel or cylinder and spindle assembly 416 (FIG. 6) to enable the handle 42 to be locked in its OPEN or OFF position, thereby preventing unauthorized use of the circuit breaker 30.

The assembly 416 includes an elongated spindle 418 having an upper head portion 420 with an elongated aperture 422 formed therethrough, an intermediately disposed reduced diameter portion 424 and a lowermost further reduced diameter portion 426. The assembly 416 also includes an elongated tubular barrel or cylinder 430 having a pair of spaced apart and aligned generally U-shaped slots 432 formed at its upper end and an inwardly projecting, reduced inner diameter portion 434 that forms an upper annular shoulder 436 and a lower annular shoulder 438. The assembly 416 also includes an elongated compression spring 440 disposed about the portion 424 and having its upper longitudinal end in contact with the shoulder 438 and its lower longitudinal in contact with an upper planer surface 442 of a rigid, formed handle bracket 444. The upper shoulder 436 is configured to engage the lower surface of the head portion 420 to limit the upward movement of the cylinder 430 (FIGS. 2–4) under the influence of the compression spring 420. The lowermost portion 426 of the spindle 418 is configured to be received within a complementarily shaped aperture 446 formed through the surface 442 of the handle bracket 444. The spindle 418 subsequently is fixedly secured to the surface 442 by peening over or otherwise physically deforming the portion 426 to form a rivet head 448.

The handle bracket 444 also includes an intermediately disposed planar portion 450 that is received and retained between an interior planar surface or underside of the lock cover 412 and the upper surface of an elongated bracket slide 452 for movement along the longitudinal axis of the bracket slide 452. The handle bracket 444 also includes a lower planar surface 454 with an elongated aperture 456 formed therethrough through which the upper portion of the handle 42 extends. In this manner, the assembly 416 moves along the slot 414 in unison with the movement of the handle 42 in the opening 44 through the top cover 32.

The force of the compression spring 440 normally retains the cylinder 430 above the slot 414 and the lock cover 412 (FIGS. 2–4), enabling the handle 42 to be moved to its ON, OFF and RESET positions. In order to lock the handle 42 in its OFF position and, thus, the contacts 50 and 52 in their OPEN position, the cylinder 430 is manually aligned with and depressed into and through a complementarily shaped enlarged locking portion 458 of the slot 414 (FIG. 5) to expose the aperture 422; and a hasp 460 of a lock 462 is positioned through the aligned slots 432 and the aperture 422, thereby retaining the cylinder 430 immobilized within the locking portion 458 of the slot 414. The handle 42 is thus retained against movement in its OFF position until the locking mechanism 410 is disengaged.

Obviously, may modifications and variations of the present invention are possible in light of the above teachings. For example, if desired, access may be provided through the lock cover 412 for engagement of the handle 42 by a motor operator to enable remote operation of the circuit breaker 30. In such a case, the locking mechanism 410 may be utilized to prevent movement both of the handle 42 and of the motor operator secured thereto or may be directly connected to the motor operator to prevent its unauthorized movement and, consequently, to prevent unauthorized movement of the handle 42. Thus, it is to be understood that, within the scope of the appended claims, the invention may be practiced otherwise than as specifically described hereinabove.

What is claimed and desired to be secured by Letters Patent is:

1. An electrical circuit breaker comprising:

a first electrical contact, a second electrical contact, said first and second contacts being movable into a CLOSED position and into an OPEN position, a case for housing the internal components of said circuit breaker including said first and second contacts, a manually engagable handle extending exteriorly of said case and capable of moving said first and second contacts alternately into said CLOSED position or into said OPEN position, and means for locking said handle against substantial movement relative to said case when said first and second contacts are in said OPEN position, said locking means comprising a first member with an elongated slot having an integrally formed enlarged opening locking portion and spring biased means of a size larger than said slot mechanically interconnected with said handle and movable along said slot, said spring biased means being so configured as to be capable of being depressedly disposed in said locking portion when said first and second contacts are in said OPEN position, said spring biased means, when depressed into said locking portion, preventing substantial movement of said handle relative to said case.

2. An electrical circuit breaker as recited in claim 1 wherein said first member comprises a lock cover fixedly secured to said case and covering said handle, said slot being formed through said lock cover.

3. An electrical circuit breaker as recited in claim 1 wherein said spring biased means comprises an elongated cylinder and an elongated spindle, said spindle being disposed within said cylinder.

4. An electrical circuit breaker as recited in claim 3 wherein said spring biased means further comprises an elongated compression spring disposed about said spindle and biasing said cylinder into contact with said spindle outside of said slot.

5. An electrical circuit breaker as recited in claim 4 wherein said cylinder is movable with respect to and along the longitudinal axis of said spindle when aligned with said locking portion of said slot.

6. An electrical circuit breaker as recited in claim 5 wherein said cylinder is substantially nonmovable along the longitudinal axis of said spindle when disposed along said slot out of alignment with said locking portion.

7. An electrical circuit breaker comprising:

a first electrical contact, a second electrical contact, said first and second contacts being movable into a CLOSED position and into an OPEN position, a case for housing the internal components of said circuit breaker including said first and second contacts, a manually engageable handle extending exteriorly of said case and capable of moving said first and second contacts alternately into said CLOSED position or into said OPEN position and means for locking said handle against substantial movement relative to said case when said first and second contacts are in said OPEN position, said locking means comprising:

a first member with an elongated slot having an integrally formed enlarged opening locking portion; and spring biased means mechanically interconnected with said handle and movable along said slot, said spring biased means capable of being depressedly disposed in said enlarged opening locking portion when said first and second contacts are in said OPEN position to prevent substantial movement of said handle relative to said case, said spring biased means comprising an elongated cylinder and an elongated spindle, said spindle being disposed within said cylinder, said cylinder having a diameter wider than said elongated slot and less than said locking portion so that, when depressed into said locking portion, said cylinder is prevented from moving along said slot, said spindle including an aperture formed therethrough for receipt of a lock hasp when said cylinder is aligned with and depressed into said locking portion of said slot.

8. A locking mechanism for controlling the movement of an externally disposed operator for placing the separable electrical contacts of an electrical circuit breaker in their OPEN position or in their CLOSED position comprising:

a first member with an elongated slot having an integrally formed enlarged opening locking portion disposed therealong, a spring biased rigid member of a size larger than said slot movable along said slot and capable of being depressedly positioned in said enlarged locking portion and means for mechanically interconnecting said spring biased member to said operator to enable movement in unison between said spring biased member and said operator, said operator being substantially immovable when said spring biased member is depressedly positioned in said locking portion of said slot.

9. A locking mechanism as recited in claim 8 wherein said first member comprises a lock cover for covering said operator.

10. A locking mechanism as recited in claim 8 further comprising an elongated spindle disposed within said rigid member, said rigid member comprising an elongated cylinder.

11. A locking mechanism as recited in claim 10 further comprising an elongated compression spring disposed about said spindle and biasing said cylinder into contact with said spindle outside of said slot.

12. A locking mechanism as recited in claim 11 wherein said cylinder is movable along the longitudinal axis of said spindle when positioned in said locking portion.

13. A locking mechanism as recited in claim 12 wherein said cylinder is substantially nonmovable along the longitudinal axis of said spindle when disposed along said slot away from said locking portion.

14. A locking mechanism for controlling the movement of an externally disposed operator for placing the separable electrical contacts of an electrical circuit breaker in their OPEN position or in their CLOSED position comprising:

a first member with an elongated slot having an integrally formed enlarged opening locking portion disposed therealong, a spring biased rigid member movable along said slot and capable of being depressedly positioned in said locking portion and comprising an elongated cylinder having a diameter wider than said slot, an elongated spindle disposed within said cylinder, said cylinder being depressedly movable along the longitudinal axis of said spindle when positioned in said enlarged opening locking portion, said spindle including an aperture formed therethrough for receipt of a lock hasp when said cylinder is depressedly positioned in said locking portion, an elongated compression spring disposed about said spindle and biasing said cylinder into contact with said spindle outside of said slot, and means for mechanically interconnecting said cylinder to said operator to enable movement in unison between said cylinder and said operator, said operator being substantially immovable when said cylinder is depressedly positioned in said locking portion of said slot.

* * * * *